US012442121B2

(12) United States Patent
Dayeon et al.

(10) Patent No.: US 12,442,121 B2
(45) Date of Patent: Oct. 14, 2025

(54) LAUNDRY MACHINE AND METHOD FOR OPERATION

(71) Applicant: Haier US Appliance Solutions, Inc., Wilmington, DE (US)

(72) Inventors: Wee Dayeon, Incheon (KR); Jaewon Jo, Gyeonggi-do (KR); Wonmyung Seo, GyeongGi-Do (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 229 days.

(21) Appl. No.: 18/364,863

(22) Filed: Aug. 3, 2023

(65) Prior Publication Data

US 2025/0043480 A1 Feb. 6, 2025

(51) Int. Cl.

| | |
|---|---|
| ***D06F 33/42*** | (2020.01) |
| ***D06F 23/04*** | (2006.01) |
| ***D06F 34/04*** | (2020.01) |
| ***D06F 34/18*** | (2020.01) |
| ***D06F 34/22*** | (2020.01) |
| ***D06F 39/08*** | (2006.01) |
| *D06F 103/04* | (2020.01) |
| *D06F 103/08* | (2020.01) |
| *D06F 103/20* | (2020.01) |
| *D06F 105/08* | (2020.01) |
| *D06F 105/52* | (2020.01) |

(52) U.S. Cl.

CPC ..... *D06F 33/42* (2020.02); *D06F 23/04* (2013.01); *D06F 34/04* (2020.02); *D06F 34/18* (2020.02); *D06F 34/22* (2020.02); *D06F 39/085* (2013.01); *D06F 2103/04* (2020.02); *D06F 2103/08* (2020.02); *D06F 2103/20* (2020.02); *D06F 2105/08* (2020.02); *D06F 2105/52* (2020.02)

(58) Field of Classification Search

None

See application file for complete search history.

(56) References Cited

U.S. PATENT DOCUMENTS

| | | | | |
|---|---|---|---|---|
| 10,349,802 | B2 | 7/2019 | Peukert et al. | |
| 2007/0151041 | A1* | 7/2007 | McAllister ..... | D06F 43/002 8/149.1 |

(Continued)

FOREIGN PATENT DOCUMENTS

| | | | |
|---|---|---|---|
| DE | 102008031249 | A1 | 1/2010 |
| EP | 3346049 | B1 | 11/2019 |
| KR | 20210028997 | A | 3/2021 |

*Primary Examiner* — Cristi J Tate-Sims

(74) *Attorney, Agent, or Firm* — Dority & Manning, P.A.

(57) ABSTRACT

A laundry washing machine appliance and method for operation are provided, including a wash basket rotatably mounted within a tub, the wash basket configured to receive laundry articles; a pump assembly configured to drain fluid from the wash basket; one or more sensors configured to obtain a pressure value, a humidity value, or both; and a controller configured to store instructions that, when executed, causes the appliance to perform operations. The operations include operating the pump assembly to perform a drain cycle; determining a pressure value over a period of time during the drain cycle; determining whether the pressure value over the period of time decreases at or above a pressure threshold rate; and operating the pump assembly in a preset cycle mode when the pressure value over the period of time is below the pressure threshold rate.

18 Claims, 5 Drawing Sheets

(56) References Cited

U.S. PATENT DOCUMENTS

| | | | | |
|---|---|---|---|---|
| 2008/0172804 | A1* | 7/2008 | Vanhazebrouck | D06F 33/34 8/158 |
| 2020/0040512 | A1* | 2/2020 | Welch | D06F 33/42 |

* cited by examiner

LAUNDRY MACHINE AND METHOD FOR OPERATION

FIELD OF THE INVENTION

The present subject matter relates generally to laundry washing machine apparatuses.

BACKGROUND OF THE INVENTION

Conventional laundry machines, such as washing machines, may include sensors for operating the laundry machine in various modes. For instance, a pressure sensor may be utilized for determining an amount of water being filled in a washing machine. Sensors may generally experience a failure during the life of the laundry machine. When a sensor fails, such as a pressure sensor, operations such as filling may be compromised, which may lead to overfilling or not performing a water fill function at all.

Sensor failure may manifest in various ways. For instance, a sensor failure may occur as a complete signal loss. In another instance, a sensor failure may occur as a fault in which the sensor is out of calibration or otherwise failing to determine or transmit correct measurements. In such an instance, a user or, the washing machine itself, may not know whether one sensor or another has failed, or whether a sensor has failed or another component is compromised.

Accordingly, a laundry machine including features addressing the aforementioned issues would be beneficial and advantageous. Furthermore, a method for operating a laundry washing machine that addresses one or more of the aforementioned issues would be beneficial and advantageous.

BRIEF DESCRIPTION OF THE INVENTION

Aspects and advantages of the invention will be set forth in part in the following description, or may be obvious from the description, or may be learned through practice of the invention.

An aspect of the present disclosure is directed to a laundry washing machine appliance including a wash basket rotatably mounted within a tub, the wash basket configured to receive laundry articles; a pump assembly configured to drain fluid from the wash basket; one or more sensors configured to obtain a pressure value, a humidity value, or both; and a controller configured to store instructions that, when executed, causes the appliance to perform operations. The operations include operating the pump assembly to perform a drain cycle; determining a pressure value over a period of time during the drain cycle; determining whether the pressure value over the period of time decreases at or above a pressure threshold rate; and operating the pump assembly in a preset cycle mode when the pressure value over the period of time is below the pressure threshold rate.

Another aspect of the present disclosure is directed to a method for operating a laundry washing machine appliance. The method includes operating a drain pump to perform a drain cycle; determining a pressure value over a period of time during the drain cycle; determining whether the pressure value over the period of time decreases at or above a pressure threshold rate; and operating the drain pump in a preset cycle mode when the pressure value over the period of time is below the pressure threshold rate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
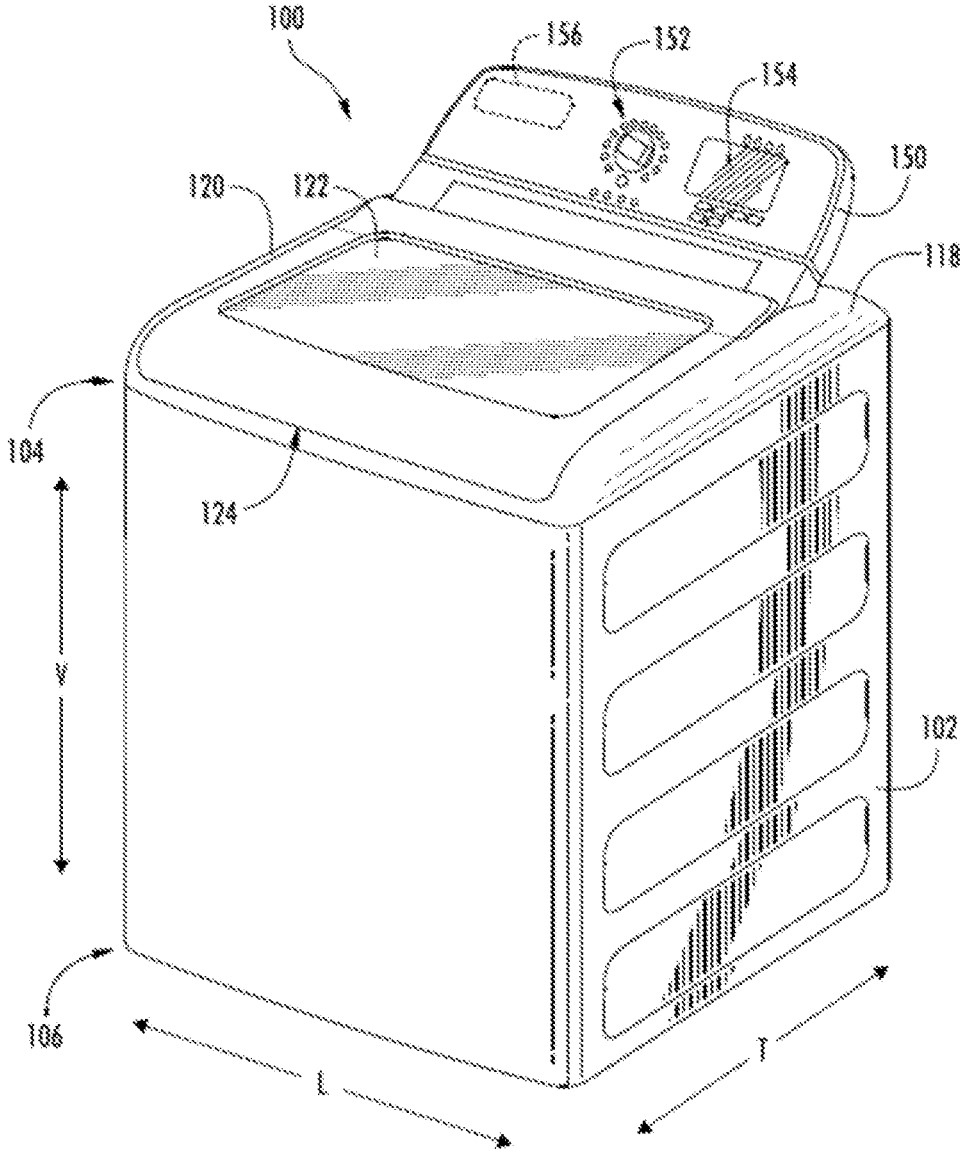
FIG. 1 provides a perspective view of a laundry washing machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
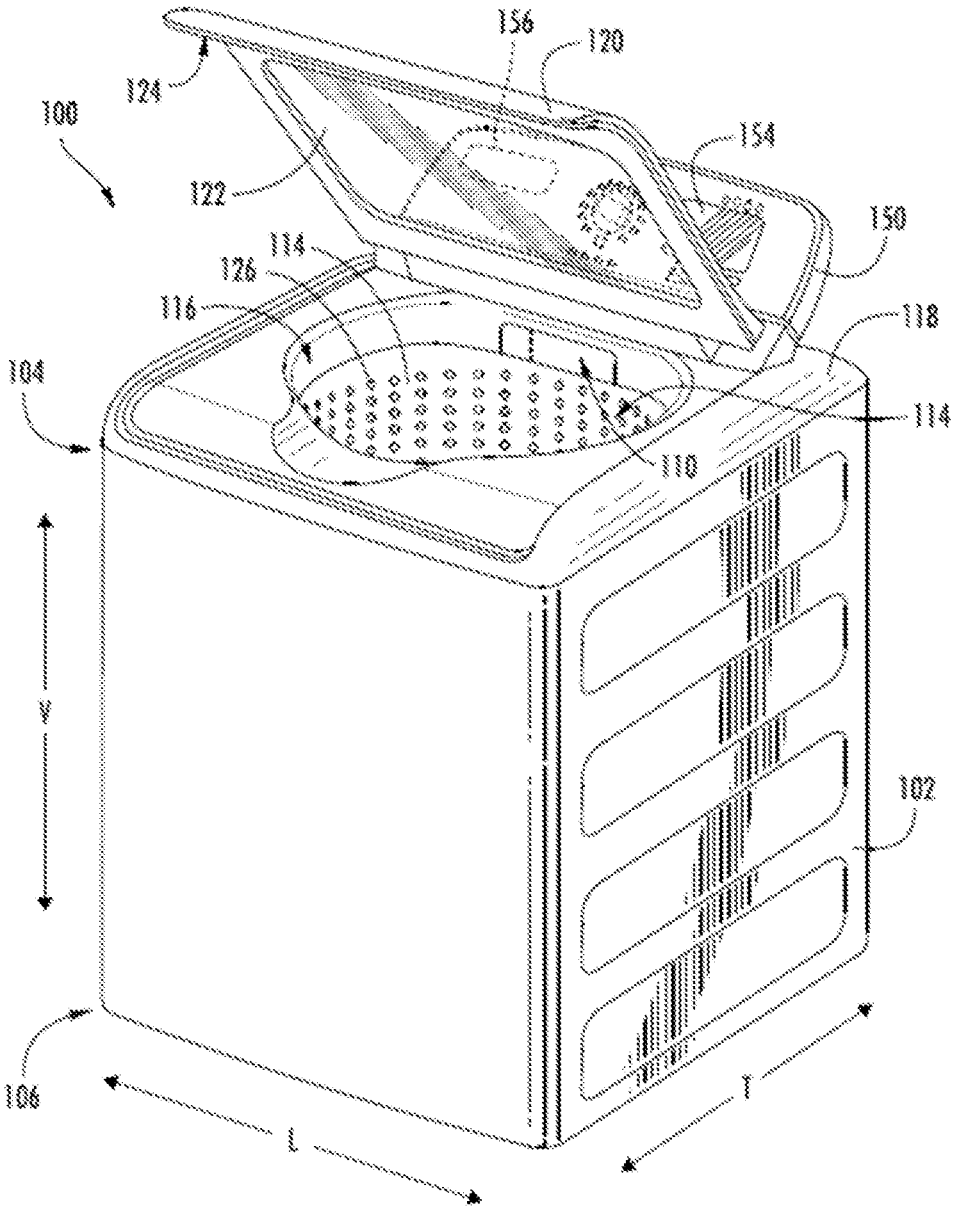
FIG. 2 provides a perspective view of the exemplary laundry washing machine appliance of FIG. 1 with the lid in an open position.
Figure 3:
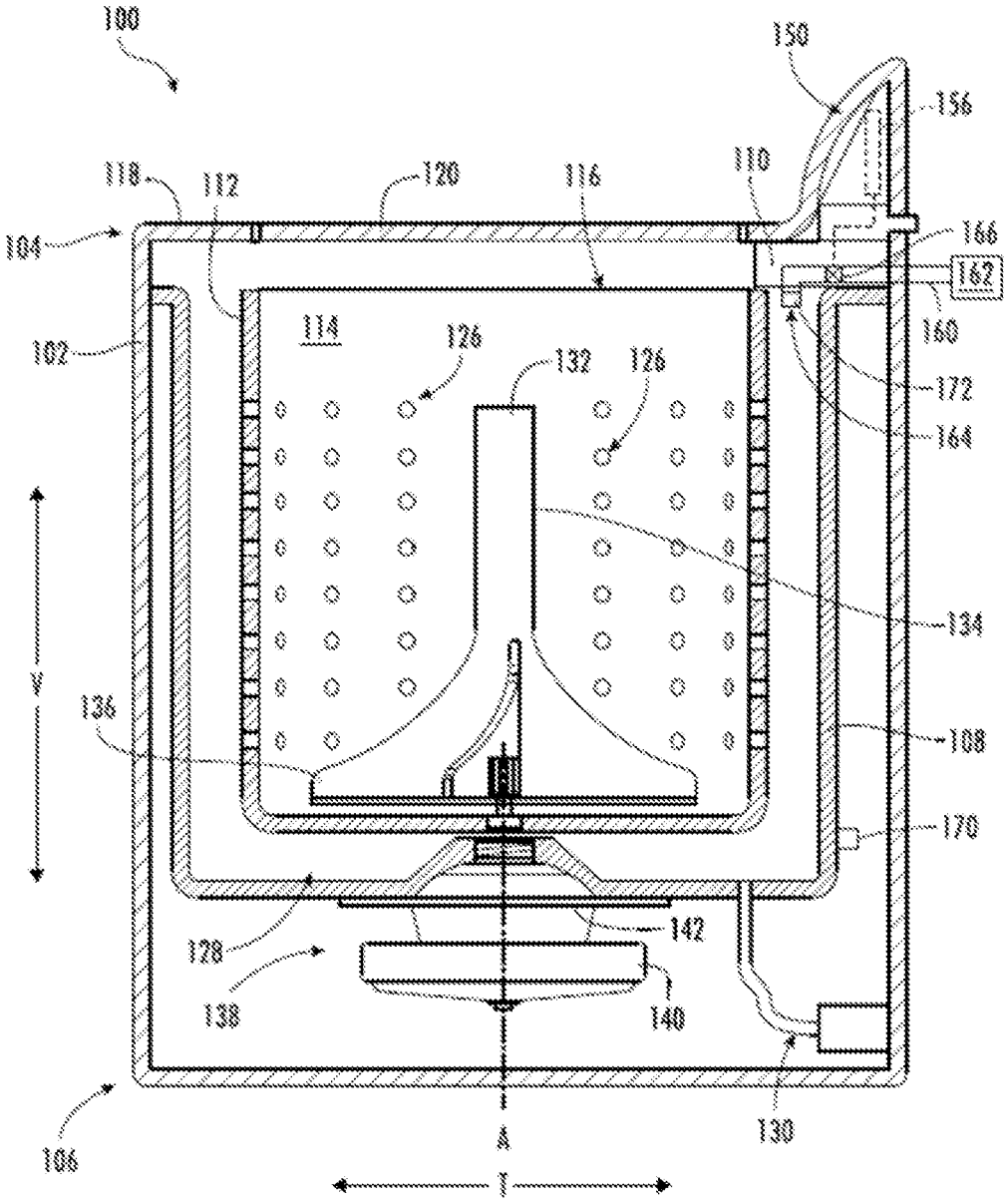
FIG. 3 provides a cut-away side view of the exemplary laundry washing machine appliance of FIG. 1.

FIGS. 1 through 3 illustrate an exemplary embodiment of a vertical axis laundry machine appliance or washing machine 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, laundry machine appliance 100 includes a drum or wash basket 112 that is positioned within tub 108 and generally defines a wash chamber 114 including an opening 116 for receipt of articles for washing. More specifically, wash basket 112 may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 defines an opening (FIG. 2) that coincides with opening 116 of wash basket 112 to permit a user access to wash basket 112. Laundry machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. Perforations 126 extend through a cylindrical wall 214 forming, at least in part, the wash basket 112 extending from a bottom base 212.

Wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle.

In some embodiments, an impeller or agitator 132 (FIG. 3), such as a vane agitator, impeller, auger, oscillatory basket mechanism, or some combination thereof may extend from base 212 to impart an oscillatory motion to articles and liquid in wash basket 112. More specifically, agitator 132 may include a shaft 134 extending along the vertical axis V and an oscillatory member 136 extending from the shaft 134. The agitator 132 may extend into wash basket and assists agitation of articles disposed within wash basket 112 during operation of laundry machine appliance 100, e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated.

As best illustrated in FIG. 3, laundry machine appliance 100 includes a drive assembly 138 in mechanical communication with wash basket 112 to selectively rotate wash basket 112 (e.g., during an agitation or a rinse cycle of laundry machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1-3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 is controlled by a controller or processing device 156 that is communicatively coupled with control panel 150 for user manipulation to select washing machine cycles and features. In response to user manipulation of control panel 150, controller 156 operates the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses.

Referring to FIG. 3, laundry machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. Laundry appliance 100 may include a flow meter 172. Flow meter 172 may be connected to water supply conduit 160 to measure an amount of water added to tub 108. Flow meter 172 may send the detected water flow amount to controller 156. In addition, laundry machine appliance 100 may include a plurality of sensors 170. Sensor(s) 170 includes a pressure sensor for detecting the amount of water and or clothes within tub 108. For example, sensor 170 may be operably coupled to a side of tub 108 for determining the weight of tub 108. Additionally or alternatively, sensor 170 may detect and/or calculate a pressure of water within tub 108. Sensor(s) 170 may further include a humidity sensor for determining moisture and providing signals for eliminating excess moisture from clothing articles.

Figure 4:
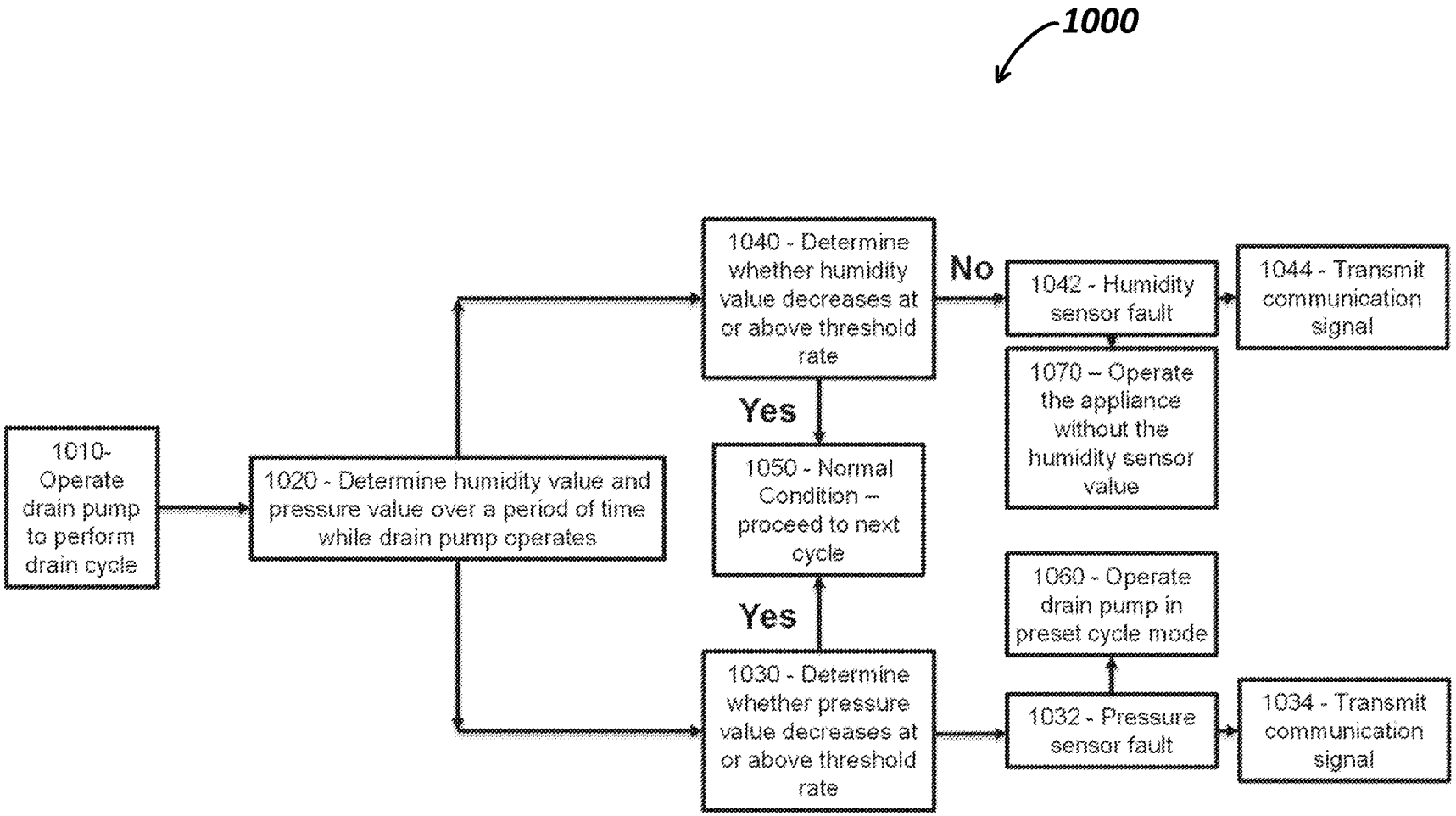
FIG. 4 provides a flowchart outlining steps of a method for operating a laundry washing machine appliance in accordance with aspects of the present disclosure.

Referring now to FIG. 4, a flowchart outlining an exemplary method for operating a washing machine appliance is provided (hereinafter, "method 1000"). Steps of method 1000 may be stored at a controller (e.g., controller 156) as instructions that, when executed by the controller, causes a washing machine appliance (e.g., appliance 100) to perform operations, such as provided in method 1000. It should be appreciated that method 1000 may be stored, performed, or executed by various embodiments of laundry machine appliance, including, but not limited to, front load or top load laundry washing appliances including a drain pump, a pressure sensor, or a humidity sensor, such as, but not limited to, embodiments depicted and described in regard to appliance 100.

Method 1000 includes at 1010 operating a drain pump (e.g., pump assembly 130) to perform a drain cycle, such as a drain cycle as may be generally understood for laundry washing appliances. During operation of the drain pump (e.g., during the drain cycle), method 1000 at 1020 measures, calculates, or otherwise determines, over a period of time, a humidity value and a pressure value, or plurality thereof (e.g., via sensor 170). Method 1000 at 1030 determines whether the pressure value(s) over time decrease at or above a first threshold rate (i.e., a threshold rate associated with the pressure value). Method 1000 at 1040 determines whether the humidity value(s) over time decrease at or above a second threshold rate (i.e., a threshold rate associated with the humidity value). Method 1000 at 1030, 1040 determines the respective decreases relative to performing the drain cycle, such as relative to during operation of the drain pump at step 1010.

Figure 5:
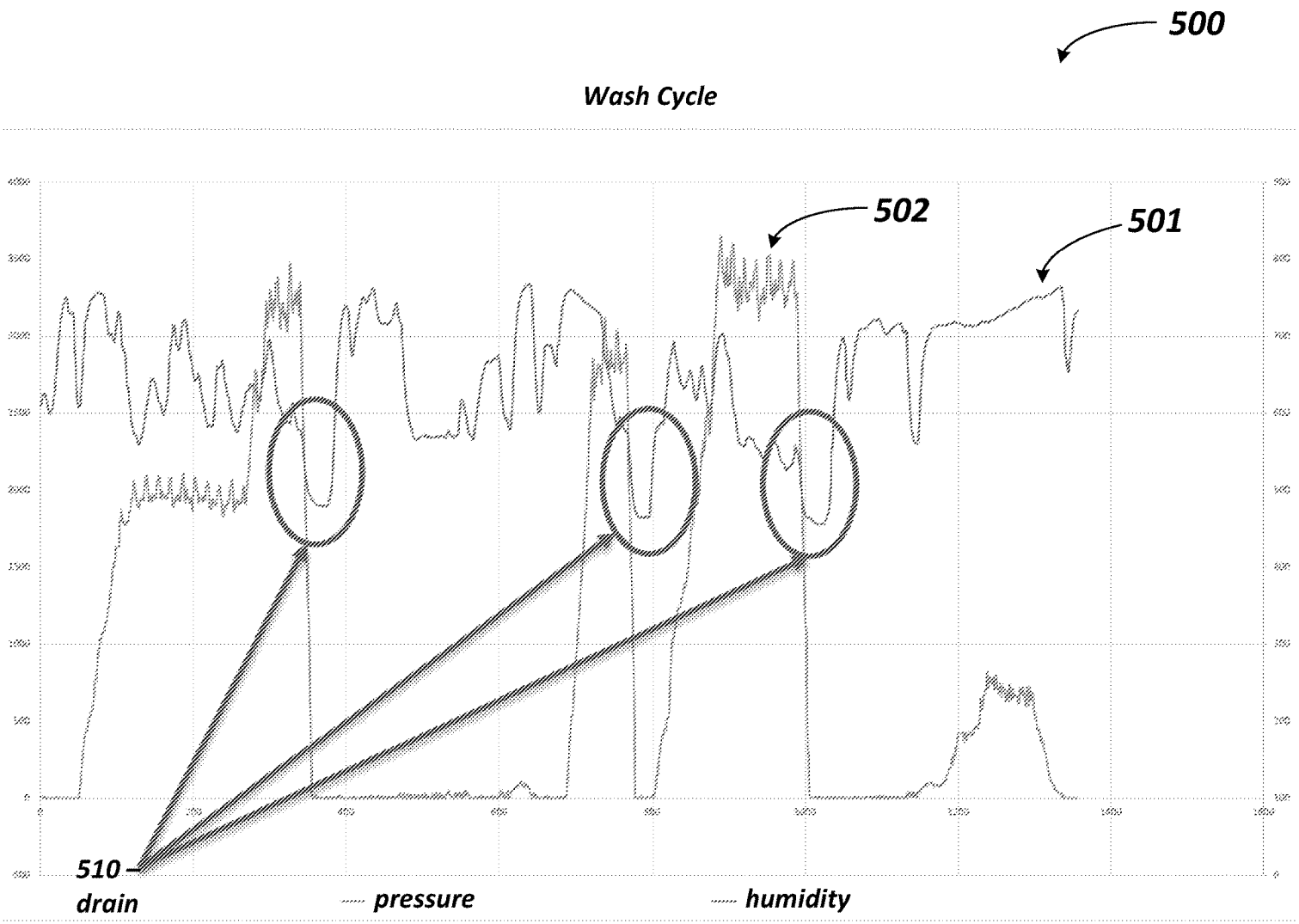
FIG. 5 provides a graph depicting an exemplary operation of the laundry washing machine appliance in accordance with aspects of the present disclosure.

Referring briefly to FIG. 5, a graph 500 depicting an exemplary wash cycle is provided. Graph 500 depicts a series of humidity values (line 501) and pressure values (line 502) over a period of time corresponding to a wash cycle. Graph 500 depicts at 510 instances at which operation of the drain pump commences, such as provided at method 1000 at step 1010. During normal operating condition (e.g., without sensor fault), pressure values and humidity values measured over the period of time (e.g., a period of time corresponding to the drain cycle, such as the period of time following commencement of operation of the drain pump) decrease. Furthermore, the values decrease at or above a magnitude over time, such as at or above a threshold rate corresponding to a threshold slope value. Accordingly, graph 500 may depict a non-fault, normal operating condition, such as method 1000 at 1050.

In various embodiments, the threshold rate is a function of a rate of change over a period of time. Method 1000 at 1030, 1040 includes a decrease in humidity or pressure over the period of time. For instance, a slope associated with the rate of change over time may be negative, such as to indicate a decline in humidity or pressure value. The period of time may include a period within one (1) second, or within five (5) seconds, or within ten (10) seconds, or within twenty (20) seconds from the start of the drain pump (e.g., from the start of the drain cycle). As depicted in FIG. 5 at 510, during normal operation, the slope is negative. When the slope is not negative, or not sufficiently negative, or flat, or positive during the period of time, method 1000 determines at 1032 a fault at the pressure sensor, or at 1042 a fault at the humidity sensor, or both.

It should be appreciated that method 1000 may include at 1030, 1040 determining the decrease at or above a threshold rate while the drain pump operates (e.g., during the drain cycle). In further embodiments, method 1000 may include at 1030, 1040 determining the decrease at or above a threshold rate over a period of time commencing with start of the drain cycle (e.g., commencing with start of operation of the drain pump). Accordingly, method 1000 may differentiate decreases generally (e.g., such as depicted in graph 500) from decreases that are to correspond to operation of the drain pump. Still further, in some embodiments, method 1000 may determine a fault at 1032, 1042 if the decreasing values occur after a threshold time limit after commencing the drain cycle.

Method 1000 may include at 1034, 1044 transmitting a communication signal (e.g., via controller 156), such as to a display device (e.g., display 154). The communication signal may include a visual or audio signal informing a user, technician, or server of a fault at the sensor. Method 1000 at 1034 may transmit a communication signal indicating a fault with the pressure sensor. Method 1000 may include at 1060 operating the drain pump in a preset cycle mode after determining a pressure sensor fault. For instance, the preset cycle mode may include operating the drain pump for a predetermined period of time during the drain cycle, rather than based on a measurements or calculations based on the pressure sensor. The preset cycle mode may result in reduced efficiency operation. However, the preset cycle mode may allow a user to continue use of the appliance until the pressure sensor fault is corrected.

Method 1000 at 1044 may transmit a communication signal indicating a fault with the humidity sensor. In some embodiments, method 1000 may include at 1070 disabling one or more operating modes utilizing the humidity sensor. For instance, method 1000 may include at 1070 utilizing a preset humidity value to continue operation of the appliance. In other instances, method 1000 at 1070 may include disabling operating modes that utilize the humidity sensor. Disabling operating modes utilizing the humidity sensor, or utilizing a preset humidity value, may result in reduced efficiency operation, but may allow a user to continue use of the appliance until the humidity sensor fault is corrected.

Embodiments of the appliance 100 and method 1000 provided herein may allow a user or technician to easily and quickly identify a fault at a pressure sensor or humidity sensor. Embodiments provided herein may allow for further operation of the appliance despite a fault, while avoiding overfilling or non-filling of water into a wash basket due to a faulty sensor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry washing machine appliance, comprising:

a wash basket rotatably mounted within a tub, the wash basket configured to receive laundry articles;

a pump assembly configured to drain fluid from the wash basket;

one or more sensors configured to obtain a pressure value, a humidity value, or both; and a controller configured to store instructions that, when executed, causes the appliance to perform operations, the operations comprising:

operating the pump assembly to perform a drain cycle;

determining a pressure value over a period of time during the drain cycle;

determining whether the pressure value over the period of time decreases at or above a pressure threshold rate; and operating the pump assembly in a preset cycle mode when the pressure value over the period of time is below the pressure threshold rate, wherein the preset cycle mode comprises operating the pump assembly for a predetermined period of time during the drain cycle without utilizing pressure values from the sensor.

2. The laundry washing machine appliance of claim 1, wherein determining whether the pressure value over the period of time decreases at or above the pressure threshold rate starts when the drain cycle commences.

3. The laundry washing machine appliance of claim 1, wherein the period of time is within twenty seconds from the start of the pump assembly.

4. The laundry washing machine appliance of claim 1, the operations comprising:

transmitting a communication signal indicating a sensor fault corresponding to the pressure value.

5. The laundry washing machine appliance of claim 1, the operations comprising:

determining a humidity value over the period of time during the drain cycle;

determining whether the humidity value over the period of time decreases at or above a humidity threshold rate; and operating the appliance without the humidity value from the sensor when the humidity value over the period of time is below the humidity threshold rate.

6. The laundry washing appliance of claim 5, wherein determining whether the humidity value over the period of time decreases at or above the humidity threshold rate starts when the drain cycle commences.

7. The laundry washing machine appliance of claim 6, wherein the period of time is within twenty seconds from the start of the pump assembly.

8. The laundry washing machine appliance of claim 5, the operations comprising:

transmitting a communication signal indicating a sensor fault corresponding to the humidity value.

9. The laundry washing machine appliance of claim 1, the operations comprising:

operating the appliance in a non-fault operating condition when the pressure value over the period of time decreases at or above the pressure threshold rate.

10. A method for operating a laundry washing machine appliance, comprising:

operating a drain pump to perform a drain cycle;

determining a pressure value over a period of time during the drain cycle;

determining whether the pressure value over the period of time decreases at or above a pressure threshold rate; and operating the drain pump in a preset cycle mode when the pressure value over the period of time is below the pressure threshold rate, wherein the preset cycle mode comprises operating the pump assembly for a predetermined period of time during the drain cycle without utilizing pressure values from the sensor.

11. The method of claim 10, wherein determining whether the pressure value over the period of time decreases at or above the pressure threshold rate starts when the drain cycle commences.

12. The method of claim 10, wherein the period of time is within twenty seconds from the start of the drain pump.

13. The method of claim 10, the method comprising:

transmitting a communication signal indicating a sensor fault corresponding to the pressure value.

14. The method of claim 10, the method comprising:

determining a humidity value over the period of time during the drain cycle;

determining whether the humidity value over the period of time decreases at or above a humidity threshold rate; and operating the appliance without the humidity value from the sensor when the humidity value over the period of time is below the humidity threshold rate.

15. The method of claim 14, wherein determining whether the humidity value over the period of time decreases at or above the humidity threshold rate starts when the drain cycle commences.

16. The method of claim 15, wherein the period of time is within twenty seconds from the start of the drain pump.

17. The method of claim 14, the method comprising:

transmitting a communication signal indicating a sensor fault corresponding to the humidity value.

18. The method of claim 10, the method comprising:

operating the appliance in a non-fault operating condition when the pressure value over the period of time decreases at or above the pressure threshold rate.

* * * * *